US006685037B1

(12) United States Patent
Zadak

(10) Patent No.: US 6,685,037 B1
(45) Date of Patent: Feb. 3, 2004

(54) TELESCOPING SHELF DIVIDER

(75) Inventor: Craig Zadak, Roscoe, IL (US)

(73) Assignee: Southern Imperial, Inc., Rockford, IL (US)

( * ) Notice: Subject to any disclaimer, the term of this patent is extended or adjusted under 35 U.S.C. 154(b) by 0 days.

(21) Appl. No.: 10/198,438

(22) Filed: Jul. 18, 2002

(51) Int. Cl.[7] ..... A47F 5/00

(52) U.S. Cl. ..... 211/184; 211/181.1; 211/43; 108/61

(58) Field of Search ..... 211/184, 59.2, 211/181.1, 43, 90.02, 88.02, 106, 41.5; 206/529, 561, 534; 108/60, 61

(56) References Cited

U.S. PATENT DOCUMENTS

| | | | | | |
|---|---|---|---|---|---|
| 934,148 | A | * | 9/1909 | Duff | 211/43 |
| 1,006,328 | A | * | 10/1911 | Widenhofer | 211/195 |
| 1,682,060 | A | * | 8/1928 | Banks | 211/43 |
| 2,061,937 | A | * | 11/1936 | Fay | 211/49.1 |
| 2,504,466 | A | * | 4/1950 | Stolzoff | 211/11 |
| 2,910,188 | A | | 10/1959 | Skolfield et al. | |
| 3,249,112 | A | * | 5/1966 | Gillette | 211/184 |
| 3,497,081 | A | | 2/1970 | Field | |
| 3,501,020 | A | | 3/1970 | Krikorian | |
| 3,692,191 | A | | 9/1972 | Moore | |
| 3,750,894 | A | * | 8/1973 | Jensen et al. | 211/184 |
| 3,850,303 | A | * | 11/1974 | Franklin | 211/134 |
| 3,868,021 | A | | 2/1975 | Heinrich | |
| 4,267,931 | A | * | 5/1981 | Belotta | 211/153 |
| 4,809,856 | A | | 3/1989 | Muth | |
| 5,161,704 | A | | 11/1992 | Valiulis | |
| 5,183,163 | A | * | 2/1993 | Slaiken | 211/43 |
| 5,209,360 | A | | 5/1993 | Valiulis | |
| 5,287,974 | A | * | 2/1994 | Buday | 211/184 |
| 5,341,945 | A | | 8/1994 | Gibson | |
| 5,381,908 | A | | 1/1995 | Hepp | |
| 5,384,937 | A | * | 1/1995 | Simon | 24/295 |
| 5,437,380 | A | * | 8/1995 | Peay et al. | 211/184 |
| 5,584,405 | A | * | 12/1996 | Tunzi | 211/153 |
| 5,803,276 | A | | 9/1998 | Vogler | |
| 5,971,173 | A | | 10/1999 | Valiulis et al. | |
| 6,341,704 | B1 | * | 1/2002 | Michel, Jr. | 211/181.1 |
| 6,457,594 | B1 | * | 10/2002 | Tiemann | 211/181.1 |

* cited by examiner

*Primary Examiner*—Daniel P. Stodola
*Assistant Examiner*—Jennifer E. Novosad
(74) *Attorney, Agent, or Firm*—Leydig, Voit & Mayer, Ltd.

(57) ABSTRACT

An adjustable divider assembly generally includes a front divider and a rear divider. The front divider comprises a front frame, a plurality of front posts, and a front clip. The rear divider comprises a rear frame, a plurality of rear posts, and a rear clip. The front and rear dividers are selectively adjustable relative to each other and are connected to each other by way of the front and rear clips. The front clip has a vertically oriented slot that is sized and positioned to receive one of the plurality of rear posts, while the rear clip also has a vertically oriented slot that is sized and positioned to receive one of the plurality of front posts.

20 Claims, 9 Drawing Sheets

TELESCOPING SHELF DIVIDER

FIELD OF THE INVENTION

This invention pertains to shelf dividers, and more particularly relates to adjustable shelf dividers.

BACKGROUND OF THE INVENTION

In retail display of merchandise, it is well-known to use long shelves to display many different articles of merchandise. In order to adequately separate this merchandise, shelf dividers are used to define specific areas having discreet boundaries for each particular product. Typically, retail shelves have a plurality of regularly spaced apertures in their support surface. Accordingly, shelf dividers may be attached at any point along the shelf by way of these apertures, thereby defining discreet areas for each product as needed.

This retail shelving also includes many variations. More particularly, such shelves have different depths. Thus, a retailer must utilize many different divider sizes to accommodate all of their shelves in the store. This requires a retailer to purchase a large number of dividers in each discrete size, many of which may not be used for any given length of time depending on the type of merchandise being displayed. Accordingly, there exists a need to provide an adjustable shelf divider which accommodates different shelf depths.

BRIEF SUMMARY OF THE INVENTION

It is a general aim of the present invention to provide an adjustable shelf divider that accommodates shelving of different depths. In furtherance of this aim, it is an object of the present invention to provide an adjustable shelf divider that is easy to use and behaves much like prior fixed length dividers. Further, it is also an object of the present invention to provide an adjustable shelf divider that maintains a slim configuration and does not utilize any more shelf space than is necessary.

One embodiment of the invention provides an adjustable divider assembly generally comprising a front divider and a rear divider. The front divider comprises a front frame, a plurality of front posts, and a front clip. The front frame includes two vertically spaced horizontally extending members. The plurality of front posts are vertically oriented and connected to the horizontally extending members. The rear divider comprises a rear frame, a plurality of rear posts, and a rear clip. The rear frame includes two vertically spaced horizontally extending members. The plurality of rear posts are vertically oriented and connected to the horizontally extending members. The front and rear dividers are selectively adjustable relative to each other and are connected to each other by way of the front and rear clips. The front clip has a vertically oriented slot that is sized and positioned to receive one of the plurality of rear posts, while the rear clip also has a vertically oriented slot that is sized and positioned to receive one of the plurality of front posts.

According to more detailed aspects of this embodiment, the front clip is attached to front posts, and the rear clip is attached to rear posts. The vertical opening of the front clip faces forwardly and the vertical opening of the rear clip faces rearwardly. Moving the front and rear dividers away from each other connects the front and rear dividers by way of the front and rear clips, while moving the front and rear dividers towards each other disconnects the front and rear dividers for relative adjustment. Preferably, the horizontally extending members of the front frame are vertically spaced a distance greater than the horizontally extending members of the rear frame are vertically spaced, whereby the front divider telescopically receives the rear divider. Also preferable, the front frame and the rear frame are aligned in a common plane when the front and rear dividers are connected to provide a slim shelf divider assembly having the same thickness as prior non-adjustable shelf dividers.

According to another embodiment of the invention, an adjustable divider assembly is provided for a shelf having regularly spaced mounting apertures. The adjustable divider assembly generally comprises a first divider having a first frame and a plurality of vertically oriented first posts connected to a side of the first frame. A second divider has a second frame and a plurality of vertically oriented second posts connected to a side of the second frame. The second frame is sized to be received within the first frame for telescopic adjustment of the first and second dividers relative to each other. Finally, the first and second frames are aligned in a common plane when the front and rear dividers are connected. Further, the plurality of front posts and the plurality of rear posts are aligned in a common plane when the front and rear dividers are connected to provide a thin divider.

According to more detailed aspects of this embodiment, a first clip is attached to the first divider and a second clip is attached to the second divider. The first clip has a vertically oriented slot positioned to selectively receive one of the plurality of second posts, and the second clip has a vertically oriented slot positioned to selectively receive one of the plurality of first posts. Preferably, the first and second clips are vertically spaced apart, and the first clip is positioned adjacent an end of the first divider that receives the second divider, while the second clip is positioned adjacent an end of the second divider that enters the first divider. It is also preferable for the first clip to be attached on a first side of the first divider and the second clip to be attached on a second side of the second divider, the second side opposing the first side. The first and second clips preferably include a generally U-shaped hook member defining the vertically oriented slots. The first and second clips are of a resilient material, and the hook members define a throat to the vertically oriented slots, the throat sized smaller than a diameter of the first and second posts to provide a snap-fit.

In yet another embodiment of the invention, an adjustable divider assembly is provided for a shelf having regularly spaced mounting apertures. The adjustable divider assembly generally comprises first and second dividers. The first divider has a first wire frame and a plurality of first posts connected to the first wire frame. The first wire frame forms a generally rectangular shape having an open side. The second divider has a second wire frame, and a plurality of second posts are connected to the second wire frame. The second wire frame forms a generally rectangular shape sized to be received within the first wire frame via the open side. Accordingly, the first and second dividers are telescopically oriented and adjustable relative to one another. A first bracket is attached to a bottom edge of the first wire frame and a second bracket attached to a bottom edge of the second wire frame. The first and second brackets each have a prong sized to extend through an aperture in the shelf to connect the first and second dividers to the shelf. The bottom edge of the second wire frame is split into first and second portions adjustable relative to each other to adjust the relative position of the first and second brackets for securely mounting the divider assembly to the shelf. Preferably, the first portion of the bottom edge is spaced vertically below the second portion of the bottom edge.

DETAILED DESCRIPTION OF THE INVENTION

Figure 1:
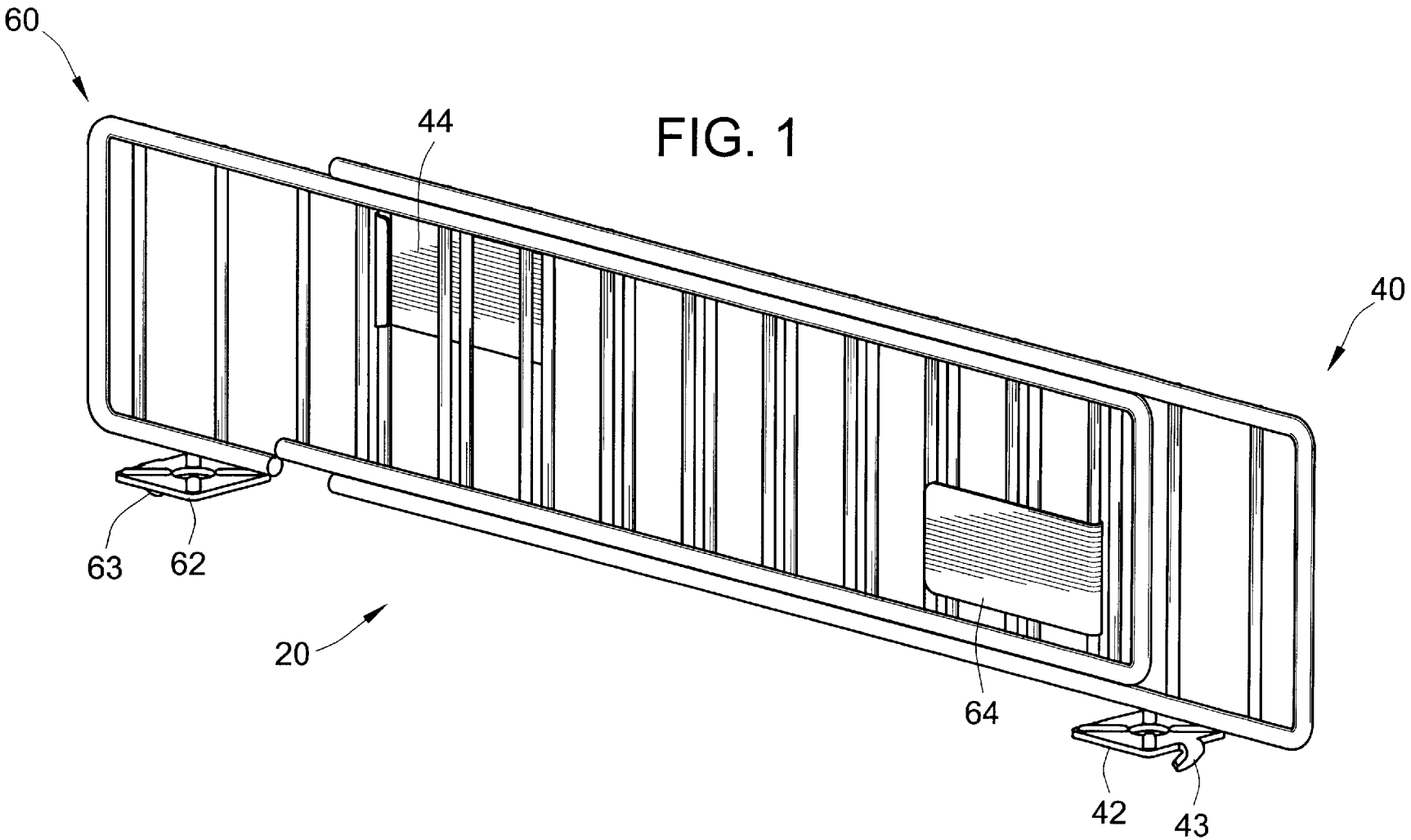
FIG. 1 is a perspective view of the adjustable shelf divider constructed in accordance with the teachings of the present invention.
Figure 2:
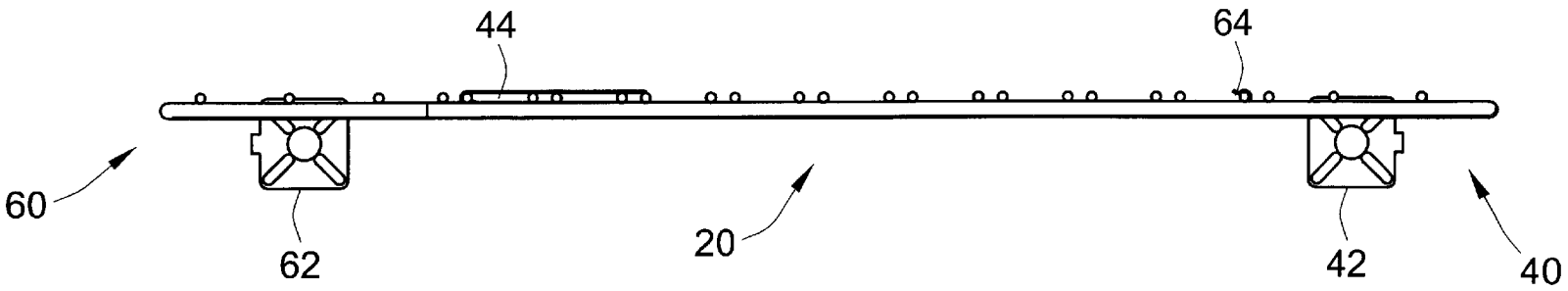
FIG. 2 is a top view of the shelf divider shown in FIG. 1.
Figure 3:
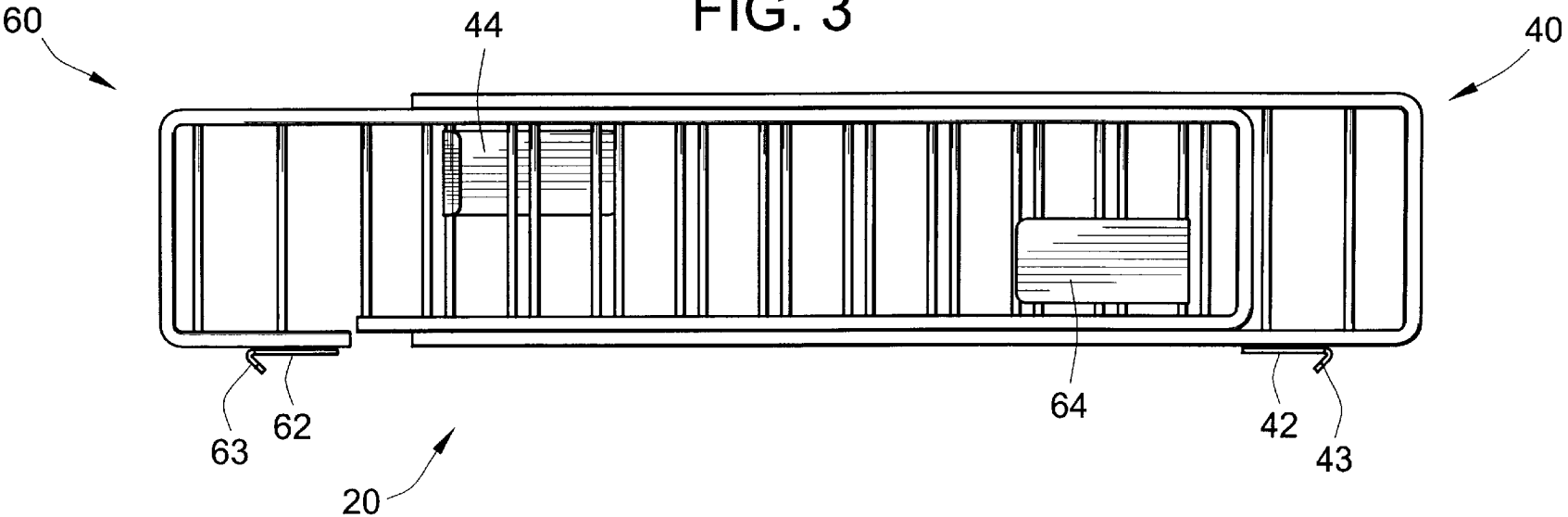
FIG. 3 is a side view of the shelf divider shown in FIG. 1.

Turning now to the figures, FIGS. 1–3 depict an adjustable divider assembly 20 constructed in accordance with the teaching of the present invention. The divider assembly 20 generally comprises a front divider 40 and a rear divider 60. The front and rear divider 40, 60 are selectively adjustable relative to each other to adjust the length of the divider assembly 20. The divider assembly 20 is connected to a shelf by way of two mounting brackets, bracket 42 being connected to the front divider 40 and bracket 62 being attached to the rear divider 60. The front and rear dividers 40, 60 are typically welded to the brackets 42, 62. The brackets 42, 62 each include a downwardly and inwardly directed prong 43, 63 that fits into regularly spaced apertures formed in the support surface of the shelf.

The front and rear dividers 40, 60 are connected to each other by clips. More particularly, the front divider includes a front clip 44 and the rear divider includes the rear clip 64. The front clip 44 is sized and positioned to engage the rear divider 60, while the rear clip 64 is sized and positioned to engage the front divider 40. This adjustable connection will be described in more detail herein.

Figure 5:
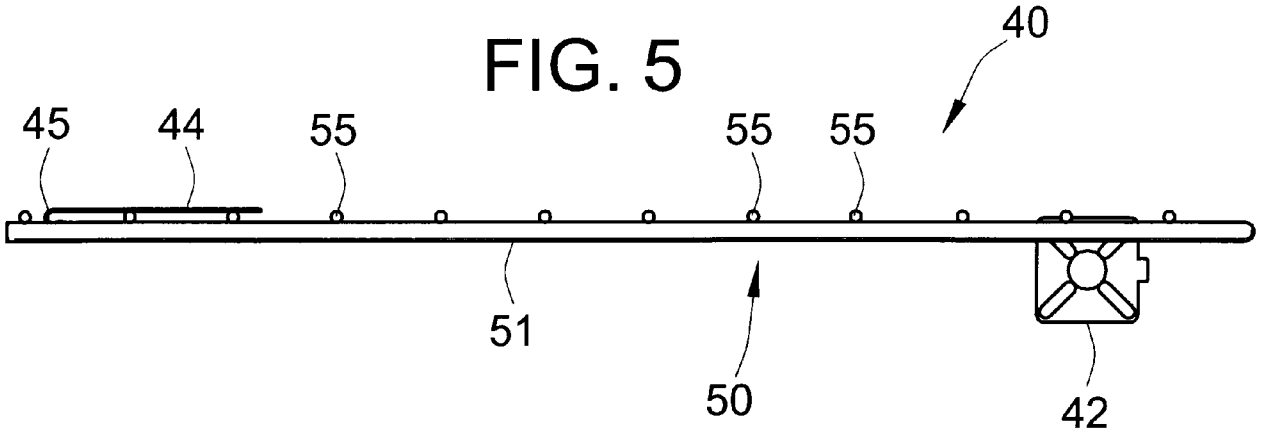
FIG. 5 is a top view of the front divider portion shown in FIG. 4.
Figure 4:
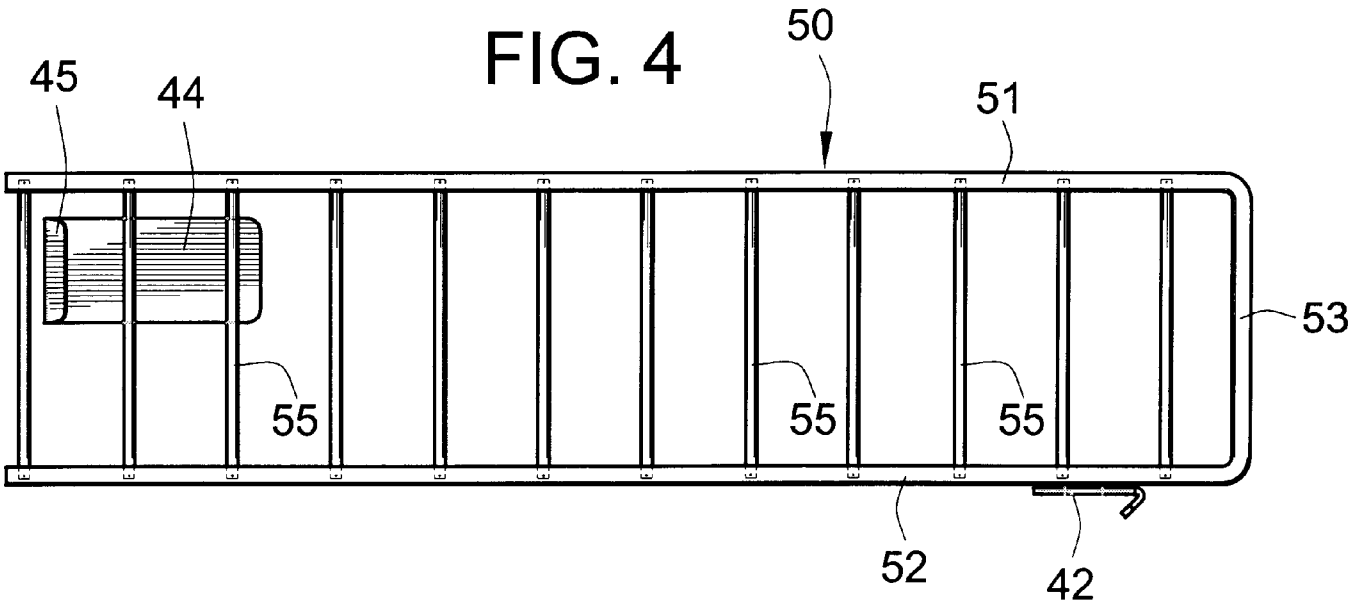
FIG. 4 is a side view of the front divider portion of the shelf divider shown in FIG. 1.

Turning now to FIGS. 4 and 5, side and top views of the front divider 40 are depicted. The front divider generally comprises a front frame 50 which defines a generally rectangular shape. The front frame 50 generally includes upper and lower horizontally extending members 51, 52 and a front edge or end member 53. Notably, the rear end or edge is left free and open to receive the rear divider 60. A plurality of front posts 55 are connected to the front frame 50. The plurality of front posts 55 are vertically oriented and connected to one common side of the horizontal members 51, 52.

Figure 8:
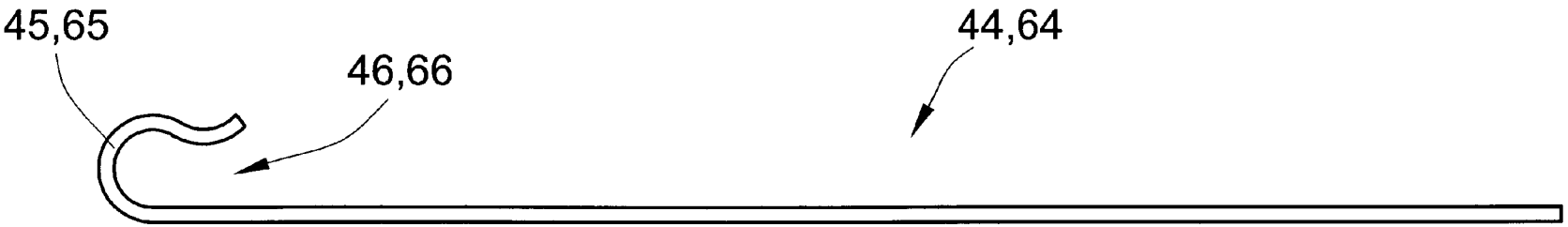
FIG. 8 is a top view of a clip utilized on the adjustable shelf divider shown in FIG. 1.

The front clip 44 is attached to a side of the portion of the front posts 55, preferably to two front posts as shown in the figures. The clip 44 as shown in detail in FIG. 8, includes a main body or plate having a hook 45 formed at one end. The hook 45 defines a vertical slot that is sized to receive a vertical post. The hook 45 is bent to include a throat 46 which is slightly smaller than the diameter of a post so that a secure snap-fit is produced. As shown in FIGS. 4 and 5, the front clip 44 is attached adjacent the rear end of the divider 40 and has its hook 45 in alignment with the vertical posts 55. The front frame 50 is preferably constructed of a metal wire that is bent into an elongated U-shape, i.e. the rectangular shape defined by horizontal members 51, 52 and front member 53. The metal wire posts 55 are then welded to the front frame 50.

Figure 7:
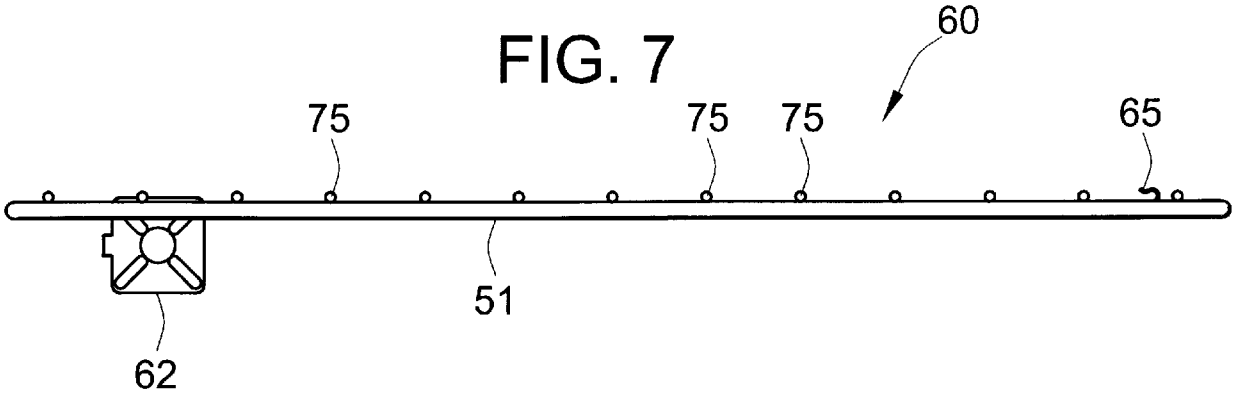
FIG. 7 is a top view of the rear divider portion shown in FIG. 6.
Figure 6:
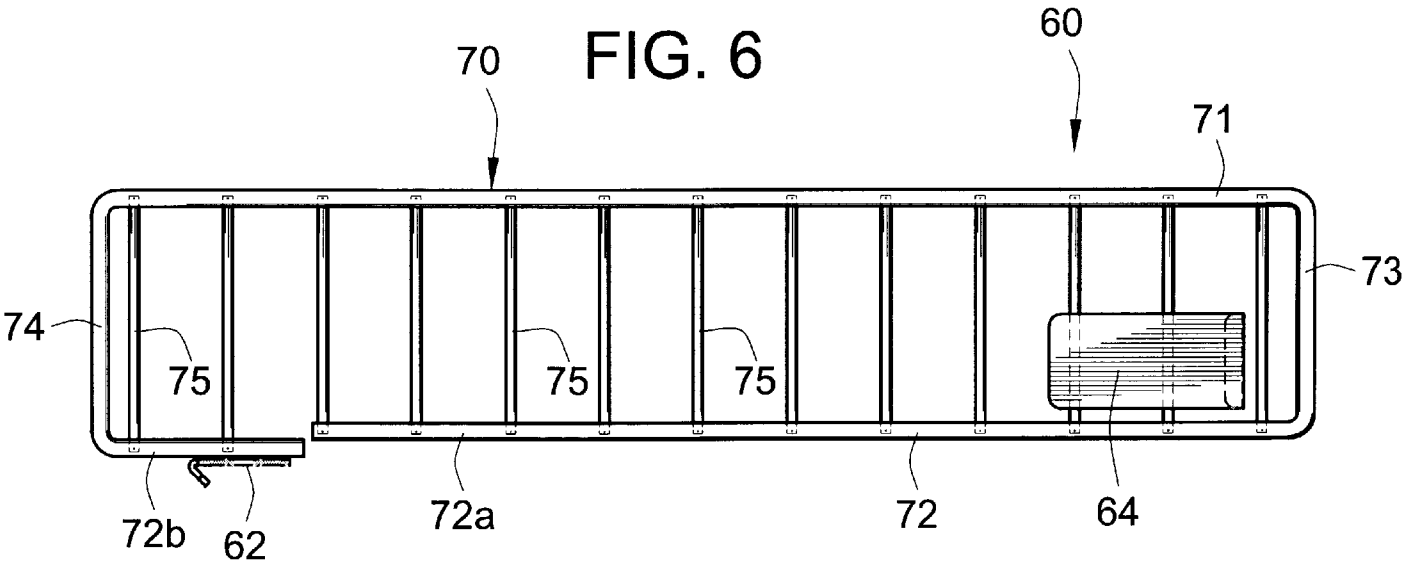
FIG. 6 is a side view of the rear divider portion of the shelf divider shown in FIG. 1.

Detailed side and top views of the rear divider are shown in FIGS. 6 and 7. The rear divider 60 generally comprises a rear frame 70 also forming a generally rectangular shape. The rear frame 70 generally comprises two horizontally extending members, 71, 72, a front member 73 and a rear member 74. A plurality of rear posts 75 are connected to the frame 70, preferably to the horizontal members 71, 72, on a side thereof. As with the front divider 40, the rear divider 60, and more particularly the rear frame 70, is constructed of a metal wire that is bent into the rectangular shape. The rear posts 75 are also constructed of metal wire and are welded to the frame 70. The rear clip 64 is attached to a front end of the rear divider 60, preferably to one or more of the rear posts 75, as shown in the figures. The hook 65 of the rear clip 64 is positioned with its vertical slot in alignment with the rear post 75.

It will also be recognized that the lower horizontal member 72 is split so that it forms a first portion 72*a* and a second portion 72*b*. Accordingly, the two portions 72*a*, 72*b* are somewhat adjustable relative to each other by bending the rear portion of the rear divider 60, and more particularly, its frame 70. The rear mounting bracket 62 is attached to the second portion 72*b* so that it is adjustable relative to the first portion 72*a* and all attached thereto. The two portions 72*a*, 72*b* are also vertically spaced, rear portion 72*b* being slightly lower. Thus it will be seen that this lower rear portion 72*b* will engage horizontal member 52 of the front frame 50 to limit the relative horizontal movement of the front and rear frames 50, 70.

Figure 9:
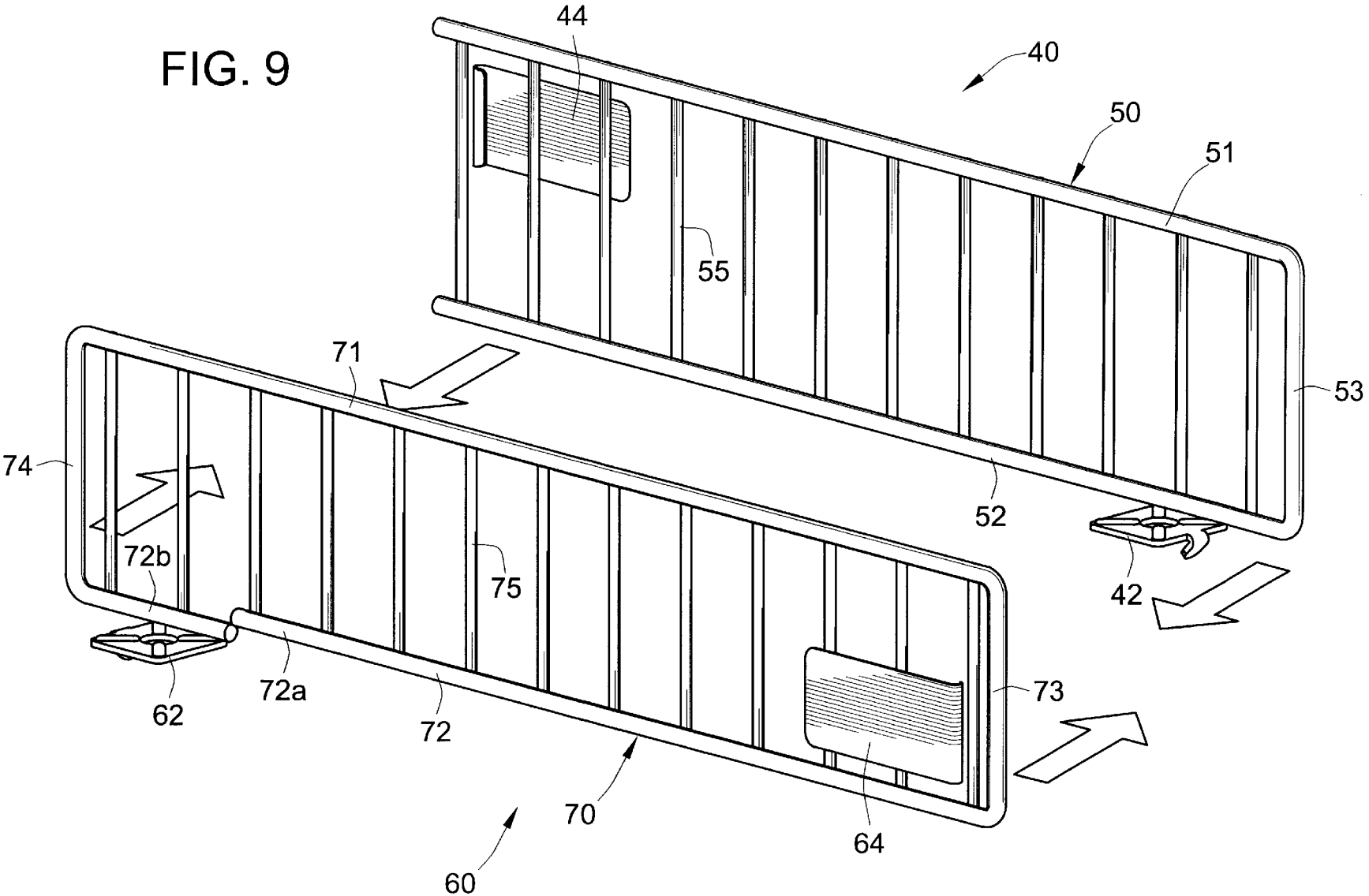
FIGS. 9–11 show sequential steps of assembling and utilizing the adjustable shelf divider shown in FIG. 1.
Figure 10:
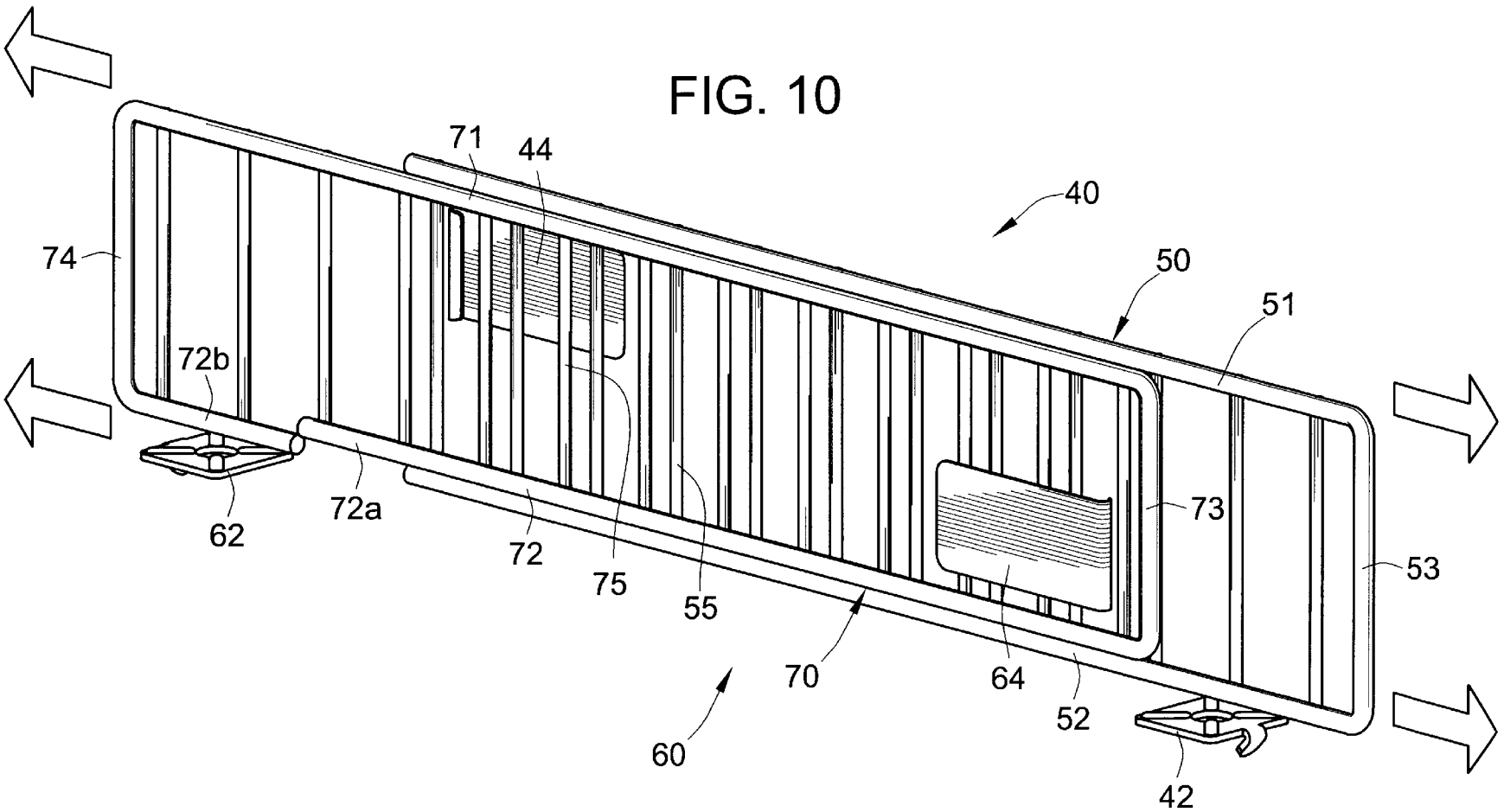

The method of assembling and adjusting the divider assembly 20 will now be described with reference to FIGS. 9–11, while reference back to FIGS. 1–3 will also be instructive. First, it will be recognized that a height of the front portion of the rear divider 60, i.e. the vertical distance between horizontal members 71, 72, is smaller than the height of the front divider 40, i.e. the vertical distance between horizontal members 51, 52. Accordingly, the front divider 40 will telescopically receive the rear portion 60. Thus the frame members 50, 70 will co-exist in the same vertical plane, as best seen in the top view of FIG. 2. Similarly, the front posts 55 and the rear post 75 will also co-exist in the same vertical plane, as also seen in FIG. 2. That is because the front posts 55 and the rear posts 75 are connected to the same side of their respective frames 50, 70.

With the front and rear dividers 40, 60 disconnected, they are laterally spaced apart and positioned relative to each other to form the overall length of the divider 20 that is desired. Then, the front and rear dividers 40, 60 are moved towards each other as shown by the arrows in FIG. 9. The front portion of the rear frame 70 is positioned within the frame 50 of the front divider 40, as shown in FIG. 10. The next step comprises connecting the front and rear dividers 40, 60 together. That step is accomplished by moving the dividers 40, 60 outwardly, i.e. away from each other is shown by the arrows in FIG. 10. This will cause the hook numbers 45, 65 to engage a post of the opposing divider. That is, the front clip 44 will engage a rear post, while the rear clip 64 will engage a front post 55 as the vertical slots of the hooks 45, 65 face each other (See FIG. 1). It can be seen that the front and rear clips 44, 64 are spaced on opposing sides of the vertical posts. Further, they are vertically spaced apart, one being on the top half of the posts and the other being on the bottom half of the posts.

The post 55, 75 on each of the front and rear dividers 40, 60 are preferably spaced apart in one-inch increments. Accordingly, the overall size of the divider assembly 20 may be adjusted in one-inch increments, preferably in the range of about 15 to 21 inches. These fixed increments also allow the mounting brackets 42, 62 to be spaced apart a known distance. For example, if the overall length of the divider assembly 20 is approximately 15 inches, the brackets 42, 62 are preferably spaced apart slightly less than 13 inches, say about 12.9 inches. This allows the divider assembly 20 be firmly connected to a shelf, as will be described below.

Figure 11:
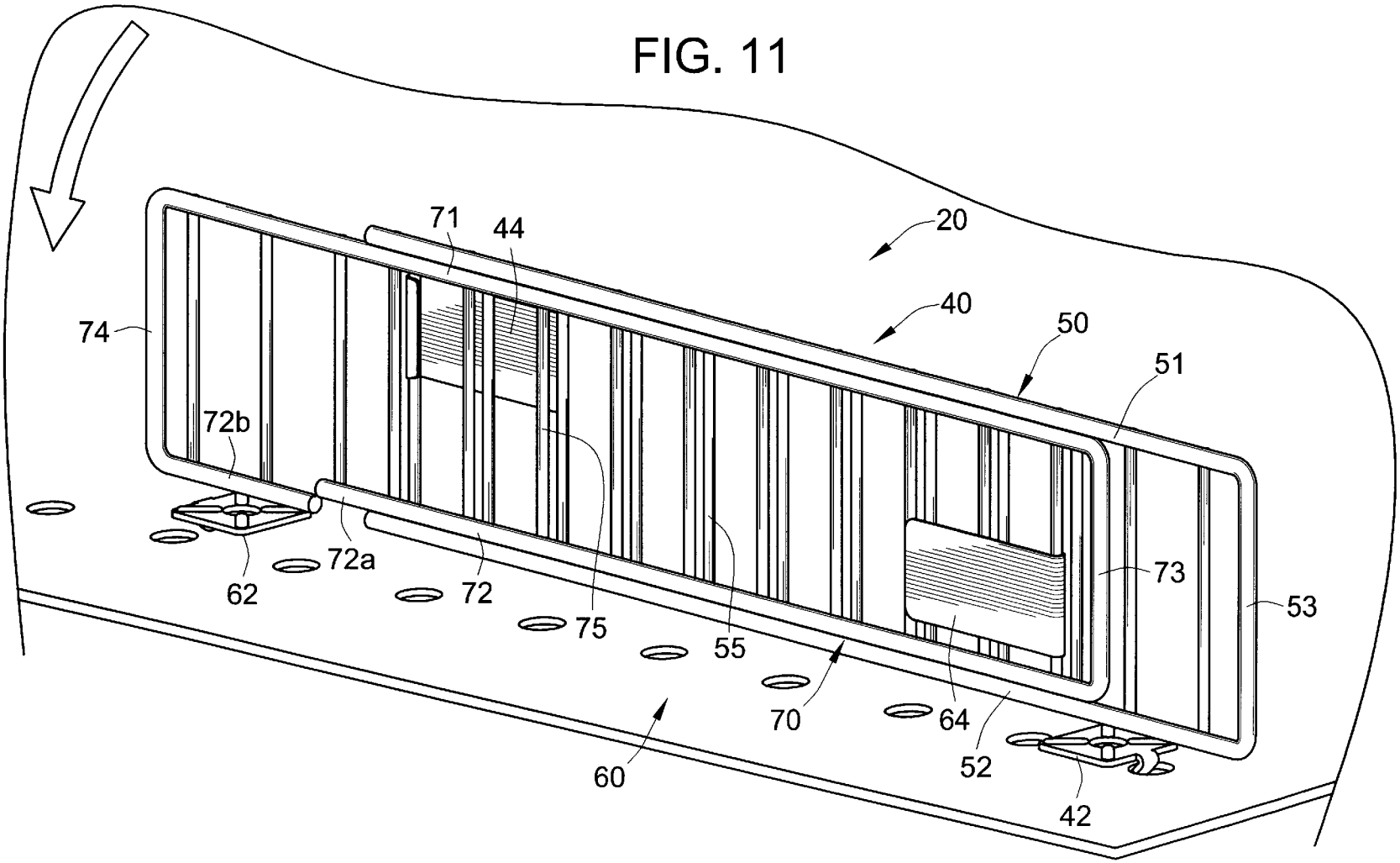

The final step involves attaching the divider assembly 20 to a shelf, as shown in FIG. 11. First, the front bracket 42 is engaged with an aperture in the shelf by way of its prong 43. Then, the rear end of the divider assembly 20 will be moved downwardly towards the shelf so that the rear bracket 62 may engage the shelf, as shown by the large arrow. As the apertures in the shelving are typically spaced apart in increments of one inch, the bracket 62 is too close to bracket 42 for both brackets and their prongs 43, 63 to be placed directly into the holes simultaneously (i.e. the 12.0 inches v. 13 inches described above). However, since the bottom horizontal member 72 of the rear divider has been split, the rear portion of the divider may be flexed or deflected (as shown by the small arrow) so that the prong 63 of rear bracket 62 may enter the appropriate hole in the shelf. Upon entering the hole, the rear divider 60 and its bracket 62 will deflect back towards the front divider 40 and bracket 42 providing a secure and tight fit to the shelf support surface. It will be recognized that the above-described steps can be reversed to detach the divider assembly 20 from the shelf and to disassemble the front and rear portion 40, 60.

Figure 12:
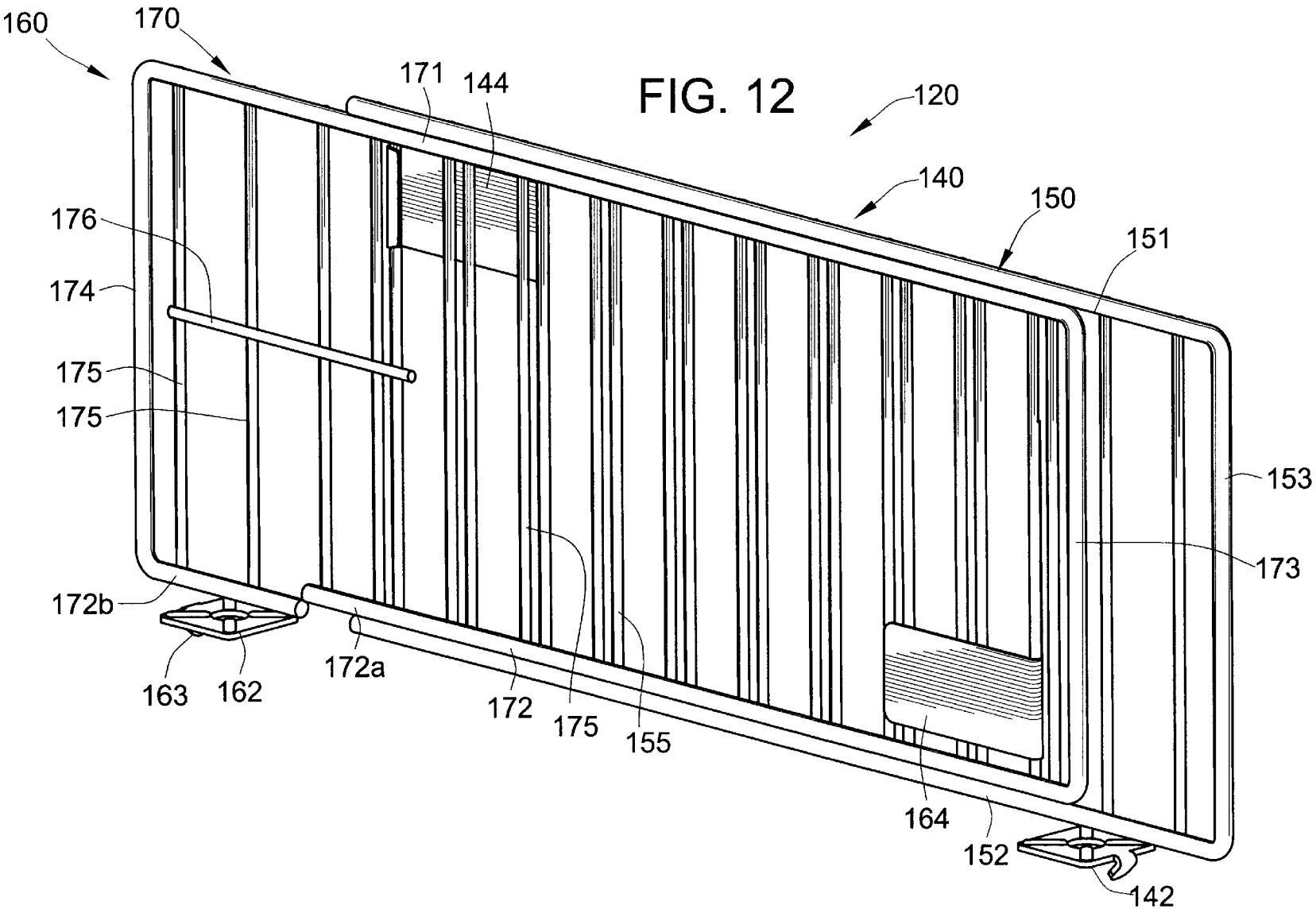
FIG. 12 is a perspective view of an alternate embodiment of the adjustable shelf divider constructed in accordance with the teachings of the present invention.

Another embodiment of the invention is shown in FIG. 12. This embodiment of the adjustable shelf divider assembly 120 behaves nearly identically to the embodiment 20 of FIGS. 1–11. Briefly, the divider assembly 120 includes a front divider 140 and a rear divider 160. The front portion of the rear divider 160 fits within the front divider 140 for telescopic adjustability. The front divider includes a front frame 150 comprised of horizontal members 151, 152 connected by vertical member 153. The rear edge of the front divider 140 is open to receive the rear divider 160. A plurality of posts 155 are vertically oriented and horizontally spaced along the front frame 150.

The rear divider 160 includes a rear frame 170 defined by horizontal members 171, 172 connected by vertical members 173, 174. A plurality of posts 175 are vertically oriented and horizontally spaced along the rear frame 170. The lower horizontal member 172 is divided into two portions, namely a front portion 172*a* and a rear portion 172*b*, thereby allowing the two portions to be adjustable relative to each other. The front portion 172*a* is spaced slightly above the rear portion 172*b*, making the front part of the rear divider 160 shorter and sized to fit within the horizontal members 151, 152 of the front divider 140 and frame 150.

A front clip 144 is attached to the front divider 140, and more specifically the rearmost posts 155 of the divider. Similarly, a rear clip 164 is attached to the rear divider 160, and more specifically the forwardmost posts 175 of the divider. The clips 144, 164 selectively connect to the opposing divider's posts 155, 175 for connecting the dividers 140, 160 at a selected length, as in the prior embodiment.

The one difference in this embodiment is that the divider assembly 120, and hence the front and rear dividers 140, 160, are taller (i.e. in the vertical direction). Nonetheless, operation is nearly identical to the first embodiment. However, to limit the adjustability of the rear portion 172*b* relative to the front portion 172*a* of the horizontal member 172, a stabilizer bar 176 has been added. The bar 176 is horizontally oriented and is connected to several rear posts 175 spanning over both the front and rear portions 172*a*, 172*b*. This provides added rigidity, but allows for operation as described above with regard to the short divider assembly 20.

By way of the present invention, it can be seen that an adjustable shelf divider has been provided which not only accommodates differently sized shelving units, but that also does not take up any more width than a regular divider, since the front and rear dividers 40, 60 are telescopically received. More specifically, the front and rear frames are aligned in a common plane, as are the front and rear posts, to minimize wasted space. Further, the brackets for attaching the front and rear ends of the divider to the shelf are adjustable relative to another to provide a secure and clamping-type fit. Finally, the utilization of front and rear clips 44, 64 provide easy to use and un-obstructive means for connecting the front and rear dividers.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An adjustable divider assembly for a shelf comprising:

a front divider comprising a front frame, a plurality of front posts, and a front clip, the front frame including two vertically spaced horizontally extending members, the plurality of front posts being vertically oriented and connected to the horizontally extending members;

a rear divider comprising a rear frame, a plurality of rear posts, and a rear clip, the rear frame including two vertically spaced horizontally extending members, the plurality of rear posts being vertically oriented and connected to the horizontally extending members; and the front and rear dividers being selectively adjustable relative to each other and being connected to each other by way of the front and rear clips, the front clip having a vertically oriented slot sized and positioned to receive one of the plurality of rear posts and the rear clip having a vertically oriented slot sized and positioned to receive one of the plurality of front posts;

wherein the front clip is attached to the front posts, and the rear attached to the rear posts; and wherein the front clip is attached to one of an upper half and a lower half of the front posts, and the rear clip is attached to the other of one of an upper half and a lower half of the rear posts.

2. The adjustable divider assembly of claim 1, wherein the plurality of front posts are connected to a side of the front divider and the plurality of rear posts are connected to a side of the rear divider, the plurality of front and rear posts being connected on corresponding sides of the front and rear dividers.

3. An adjustable divider assembly for a shelf comprising:

a front divider comprising a front frame, a plurality of front posts, and a front clip, the front fame including two vertically spaced horizontally extending members, the plurality of front posts being vertically oriented and connected to the horizontally extending members;

a rear divider comprising a rear frame, a plurality of rear posts, and a rear clip, the rear frame including two vertically spaced horizontally extending members, the plurality of rear posts being vertically oriented and connected to the horizontally extending members;

the front and rear dividers being selectively adjustable relative to each other and being connected to each other by way of the front and rear clip, the front clip having a vertically oriented slot sized and positioned to receive one of the plurality of rear posts and the rear clip having a vertically oriented slot sized and positioned to receive one of the plurality of front posts; and wherein the vertical slot of the front clip faces forwardly and the vertical slot of the rear clip faces rearwardly.

4. The adjustable divider assembly of claim 3, wherein moving the front and rear dividers away from each other connects the front and rear dividers by way of the front and rear clips, and wherein moving the front and rear dividers towards each other disconnects the front and rear dividers for relative adjustment.

5. An adjustable divider assembly for a shelf comprising:

a front divider comprising a front frame, a plurality of front post, and a front clip, the front frame including two vertically spaced horizontally extending members, the plurality of front posts being vertically oriented and connected to the horizontally extending members;

a rear divider comprising a rear frame, a plurality of rear posts, and a rear clip, the rear frame including two vertically spaced horizontally extending members, the plurality of rear posts being vertically oriented and connected to the horizontally extending members;

the front and rear dividers being selectively adjustable relative to each other and being connected to each other by way of the front and rear clip, the front clip having a vertically oriented slot sized and positioned to receive one of the plurality of rear posts and the rear clip having a vertically oriented slot sized and positioned to receive one of the plurality of front posts;

wherein the horizontally extending members of the front frame are vertically spaced a distance greater them the horizontally extending members of the rear frame are vertically spaced; and wherein the front divider telescopically receives the rear divider.

6. An adjustable divider assembly for a shelf comprising:

a front divider comprising a front frame, a plurality of front posts, and a front clip, the front frame including two vertically spaced horizontally extending members, the plurality of front posts being vertically oriented and connected to the horizontally extending members;

a rear divider comprising a rear frame, a plurality of rear posts, and rear clip, the rear frame including two vertically spaced horizontally extending members, the plurality of rear posts being vertically oriented and connected to the horizontally extending members;

the front and rear dividers being selectively adjustable relative to each other and being connected to each other by way of the front and rear clips, the front clip having a vertically oriented slot sized and positioned to receive one of the plurality of rear posts and the rear clip having a vertically oriented slot sized and positioned to receive one of the plurality of front posts; and wherein the front frame and the rear frame are aligned in a common plane when the front and rear dividers are connected.

7. The adjustable divider assembly of claim 6, wherein the plurality of front posts and the plurality of rear posts are aligned in a common plane when the front and rear dividers are connected.

8. An adjustable divider assembly for a shelf having regularly spaced mounting apertures, the adjustable divider assembly comprising:

a first divider having a first frame and a plurality of vertically oriented first posts connected to a side of the first frame;

a second divider having a second frame and a plurality of vertically oriented second posts connected to a side of the second frame;

the second frame sized to be received within the first frame for telescopic adjustment of the first and second dividers relative to each other; and the first and second frames being aligned in a common plane when the front and rear dividers are connected, and the plurality of front posts and the plurality of rear posts being aligned in a common plane when the first and second dividers are connected.

9. The adjustable divider assembly of claim 8, further comprising a first clip attached to the first divider and a second clip attached to the second divider, the first clip having a vertically oriented slot positioned to selectively receive one of the plurality of second posts, and the second clip having a vertically oriented slot positioned to selectively receive one of the plurality of first posts.

10. The adjustable divider assembly of claim 9, wherein the first and second clips are vertically spaced apart.

11. The adjustable divider assembly of claim 9, wherein the first clip is positioned adjacent an end of the first divider that receives the second divider, and wherein the second clip is positioned adjacent an end of the second divider that enters the first divider.

12. The adjustable divider assembly of claim 9, wherein the vertical slot of the first clip opens towards the second clip, and wherein the vertical slot of the second clip opens towards the first clip.

13. The adjustable divider assembly of claim 9, wherein the first clip is attached on a first side of the first divider and the second clip is attached on a second side of the second divider, the second side opposing the first side.

14. The adjustable divider assembly of claim 9, wherein the first and second clips include a generally U-shaped hook member defining the vertically oriented slots.

15. The adjustable divider assembly of claim 14, wherein the first and second clips are of a resilient material, and the hook members define a throat to the vertically oriented slots, the throat sized smaller than a diameter of the first and second posts.

16. The adjustable divider assembly of claim 8, further comprising a first bracket attached to a bottom edge of the first frame and a second bracket attached to a bottom edge of the second frame, the first and second brackets having a prong sized to extend through an aperture in the shelf to connect the first and second dividers to the shelf, the bottom edge of the second frame being split into first and second portions adjustable relative to each other to adjust the relative position of the first and second brackets for clamping the divider assembly to the shelf.

17. An adjustable divider assembly for a shelf having regularly spaced mounting apertures, the adjustable divider assembly comprising:

a first divider having a first wire frame and a plurality of first posts connected to the first wire frame, the first wire frame forming a generally rectangular shape having an open side;

a second divider having a second wire frame, a plurality of second posts connected to the second wire frame, the second wire frame forming a generally rectangular shape sized to be received within the first wire frame via the open side;

the first and second dividers being telescopically oriented and adjustable relative to one another;

a first bracket attached to a bottom edge of the first wire frame and a second bracket attached to a bottom edge of the second wire frame, the first and second brackets having a prong sized to extend through an aperture in the shelf to connect the first and second dividers to the shelf; and the bottom edge of the second wire frame being split into first and second portions adjustable relative to each other to adjust the relative position of the first and second brackets.

18. The adjustable divider assembly of claim 17, wherein the first portion of the bottom edge is spaced vertically below the second portion of the bottom edge.

19. The adjustable divider assembly of claim 17, wherein the first and second dividers are aligned in a common plane when connected.

20. The adjustable divider assembly of claim 17, further comprising a first clip attached to at least one of the first posts and having a slot sized and positioned to receive one of the second posts, and a first clip attached to at least one of the first posts and having a slot sized and positioned to receive one of the second posts.

* * * * *

UNITED STATES PATENT AND TRADEMARK OFFICE

CERTIFICATE OF CORRECTION

PATENT NO. : 6,685,037 B1
DATED : February 3, 2004
INVENTOR(S) : Craig Zadak

It is certified that error appears in the above-identified patent and that said Letters Patent is hereby corrected as shown below:

Column 7,
Line 22, after “and the rear”, insert -- clip is --
Line 35, change “fame” to -- frame --
Line 46, change “rear clip” to -- rear clips --
Line 62, change “front post” to -- front posts --

Column 8,
Line 6, change “rear clip” to -- rear clips --
Line 25, change “and rear” to -- and a rear --

Signed and Sealed this

Thirteenth Day of April, 2004

JON W. DUDAS
*Acting Director of the United States Patent and Trademark Office*